United States Patent [19]

Bayer

[11] Patent Number: 4,817,354

[45] Date of Patent: Apr. 4, 1989

[54] SPACER FRAME FOR INSULATING-GLASS PANES AND METHOD AND APPARATUS FOR TREATING THE SAME

[75] Inventor: Franz Bayer, Elzach, Fed. Rep. of Germany

[73] Assignee: Franz Xaver Bayer Isolierglasfabrik KG, Elzach, Fed. Rep. of Germany

[21] Appl. No.: 36,186

[22] Filed: Apr. 9, 1987

Related U.S. Application Data

[63] Continuation of Ser. No. 805,987, Dec. 5, 1985, abandoned.

[30] Foreign Application Priority Data

Dec. 15, 1984 [DE] Fed. Rep. of Germany ..... 3445838

[51] Int. Cl.[4] ..... E04B 1/70

[52] U.S. Cl. ..... 52/302; 52/303; 52/172

[58] Field of Search ..... 52/302, 303, 98, 99, 52/172, 791; 428/34

[56] References Cited

U.S. PATENT DOCUMENTS

| | | | |
|---|---|---|---|
| 3,646,981 | 3/1972 | Barnes | 411/82 |
| 3,835,615 | 9/1974 | King, Jr. | 52/98 X |
| 4,137,680 | 2/1979 | Doonan | 52/303 |
| 4,332,243 | 6/1982 | Gutnick | 52/98 X |
| 4,462,194 | 7/1984 | Wahner | 411/82 X |
| 4,520,602 | 6/1985 | Miller | 52/172 X |
| 4,576,841 | 3/1986 | Lingemann | 52/172 X |

FOREIGN PATENT DOCUMENTS

| | | | |
|---|---|---|---|
| 481423 | 3/1977 | Australia | 52/172 |

*Primary Examiner*—David A. Scherbel
*Assistant Examiner*—Creighton Smith
*Attorney, Agent, or Firm*—Peter K. Kontler

[57] ABSTRACT

The extruded aluminum spacer frame for insertion between the light-transmitting plates of an insulating-glass pane is formed with one or more pairs of transversely extending aligned openings for admission of a gas into the space within the confines of the frame, for evacuation of a gas from such space, or for regulation of the pressure within the space. If the openings are to be sealed, a tough elastic sealing compound is introduced by way of one opening of each pair so as to form in the internal space of the frame a block which sealingly contacts the inner side of the frame all the way around both openings of the respective pair. A plug is thereupon threaded or driven into one of the openings and close to or even into the other opening in order to urge the mass of sealing compound into sealing contact with the frame around both openings as well as to be maintained in sealing contact with the adjacent material of the compound.

19 Claims, 3 Drawing Sheets

SPACER FRAME FOR INSULATING-GLASS PANES AND METHOD AND APPARATUS FOR TREATING THE SAME

This application is a continuation of application Ser. No. 805,987, filed Dec. 5, 1985, now abandoned.

BACKGROUND OF THE INVENTION

The present invention relates to so-called insulating-glass units or panes which can be used as shatter-, bullet- and/or sound-proof barriers and/or as thermally insulating light-transmitting inserts in windows, doors or the like. More particularly, the invention relates to improvements in laminates of the type disclosed in my U.S. Pat. No. 4,299,639. Still more particularly, the invention relates to improvements in spacer frames of the type disclosed in the commonly owned copending patent application Ser. No. 598,444 filed Aug. 9, 1984 for "Method of and apparatus for making spacers for use in multiple-pane windows or the like". Reference may also be had to DE-OS 30 32 825.

Spacer frames are normally made from extruded hollow aluminum profiles which are filled with a flowable pulverulent or granular desiccant and are bent into the form of or otherwise assembled into rectangles or otherwise configurated circumferentially complete bodies for insertion between the marginal portions of two overlapping light-transmitting plates. Such spacer frames are or can be formed with one or more openings for admission or evacuation of a gaseous fluid. The opening or openings are provided in that wall or those walls of the frame which extend between and are not immediately adjacent to the plates. The opening or openings are tightly sealed when the installation of the frame between two spaced-apart parallel light-transmitting plates is completed or is about to be completed.

One or more openings are normally provided (as a rule by drilling) into the frame of an insulating-glass pane or unit wherein the space which is surrounded by the spacer frame-is to be filled with a gaseous fluid other than air. The gas which is to ultimately fill the space within the confines (not in the interior) of the spacer frame is admitted by way of a first opening, and such gas expels air by way of a second opening. The first opening is normally located at a level below the second (air evacuating) opening. Once the space within the frame is filled with the selected gaseous fluid, the two openings are sealed to prevent the flow of air, steam and/or any other fluid media therethrough. In many instances, the openings are sealed by a compound which is admitted between the marginal portions of the light-transmitting plates and surrounds the spacer frame. In other words, the openings are sealed from the atmosphere by a compound which surrounds the outer wall of the tubular body of the frame and not by bungs, plugs, corks or otherwise configurated male sealing members extending into the openings. The absence of such positive sealing is likely to result in leakage of gases into and from the interior of the spacer frame. If a plug is used, it normally extends well beyond the outer side of the spacer frame so that it is visible in the fully assembled laminated pane to detract from its appearance. Moreover, heretofore known and used sealing devices (including plugs and sealing compounds) cannot ensure reliable sealing of the openings for extended periods of time (particularly for several years) so that the space within the confines of the spacer frame is likely to receive moisture which condenses and fogs the light-transmitting plates.

Another drawback of heretofore known spacer frames with openings for admission of gaseous fluids into and for evacuation of gaseous fluids from the spaces within the confines of such frames is that the frames cannot be filled with a desiccant because the desiccant (or a high percentage of desiccant) would be expelled during expulsion of air from the space within the confines of the frame. The desiccant would also tend to flow from the internal space of the frame into the space within the confines of the frame to detract from the appearance of the finished insulating-glass units.

Another reason for the making of holes (normally a single hole) in the spacer frame of an insulating-glass plate is to allow for long-lasting utilization of the insulating-glass unit at locations well above the sea level, even if the unit was manufactured in a plant much closer to the sea level. In such instances, the single opening is connected with a pressure equalizing or balancing device which ensures that the pressure differential (if any) between the space within the confines of the frame and the surrounding atmosphere will not deviate from a desirable range. The problems which are encountered due to the provision of a single hole for pressure balancing purposes are the same as the aforediscussed problems in connection with the holes or openings which are made for the purpose of admitting a selected gaseous fluid into and for expelling air from the space within the confines of the frame, i.e., the internal space of the frame and/or the space within the confines of the frame is not likely to be adequately sealed from the surrounding atmosphere and/or the seals which are used for the hole or holes are likely to detract from the appearance of the insulating-glass unit. Moreover, the internal space of the frame cannot be filled with a desiccant.

OBJECTS AND SUMMARY OF THE INVENTION

An object of the invention is to provide a spacer frame which can be used in insulating-glass panes or units and is constructed and assembled in such a way that it can be filled or nearly filled with a flowable desiccant even though it is formed with one or more openings for admission or evacuation of gaseous fluids and/or for equalization or balancing of pressure in the space within the confines of the frame.

Another object of the invention is to provide a spacer frame wherein the presence of one or more openings and/or sealing means therefor does not detract from the appearance of the frame and/or of the unit wherein the frame is put to use.

A further object of the invention is to provide a frame wherein one or more openings can be completely sealed against the penetration of moisture into the space within the confines of the frame, even if the latter is not surrounded by a mass of sealing compound subsequent to installation between two light-transmitting plates or is merely surrounded by a very thin layer of such compound.

An additional object of the invention is to provide a spacer frame which can be used in presently known insulating-glass units as a superior substitute for heretofore known frames.

Another object of the invention is to provide a frame which can be formed with one or more transverse openings and can be filled or practically filled with desiccant without risking penetration of the desiccant into the space within the confines of the frame and/or into the surrounding area.

Still another object of the invention is to provide a novel and improved method of making transverse holes in spacer frames for use in insulating-glass panes or units and of treating such frames subsequent to the making of holes therein.

A further object of the invention is to provide a simple method of preventing the escape of desiccant from the internal space of a spacer frame which is formed with one or more gas-admitting, gas-evacuating and/or gas pressure regulating holes.

An additional object of the invention is to provide a method which renders it possible to fluidtightly seal the opening or openings in the spacer frame for practically unlimited intervals of time and in a simple, inexpensive and time-saving manner.

Another object of the invention is to provide a novel and improved method of preventing the penetration of moisture into the space between the major portions of two spaced-apart glass plates forming part of an insulating-glass unit in spite of the fact that the spacer frame of the unit is formed with one or more pairs of aligned openings in those walls of the frame which extend transversely between the marginal portions of the plates.

An additional object of the invention is to provide a novel and improved apparatus for the practice of the above outlined method.

Another object of the invention is to provide the apparatus with novel and improved means for sealing the internal space of the frame in the region of each opening or each pair of aligned openings.

A further object of the invention is to provide the apparatus with novel and improved means for supporting various frame-engaging units or assemblies.

One feature of the invention resides in the provision of a spacer frame for insulating-glass panes or the like. The frame comprises a tubular body (e.g., an extruded hollow aluminum profile) which defines an elongated internal space (such space is preferably filled or nearly filled with a flowable pulverulent or granular desiccant) and has at least one opening (e.g., a round hole) which communicates with the space, a mass or block of sealing compound which is confined in the internal space of the frame in the region of the opening and sealingly surrounds the opening, and a sealing element (hereinafter called plug for short) which extends into the tubular body by way of the opening and is surrounded by the sealing compound. The plug is preferably in pronounced sealing contact with the sealing compound.

The tubular body preferably includes two spaced-apart walls which extend transversely of the light-transmitting plates that flank the spacer frame in an assembled insulating-glass unit, and the opening is provided in one of the two walls. The frame is preferably formed with a second opening which is obtained by removing material from the other wall so that the second opening is at least substantially aligned with the opening in the first wall. The mass or block of sealing compound then extends across the internal space of the spacer frame so that it sealingly engages the inner sides of both walls all the way around the respective openings. The plug extends from the outside of the frame, through the opening in the one wall and toward and preferably into the second opening. The sealing compound is preferably elastic and exhibits the tendency to contract against the external surface of the plug in the internal space of the frame. For example, the plug can be formed with an external thread and is designed to cut a thread into the block of sealing compound in the internal space of the frame. This ensures the establishment of a highly reliable seal between the externally threaded part of the plug and the sealing compound in the internal space of the frame. Since the compound sealingly contacts the inner sides of the walls in the regions of and all the way around the respective openings, such openings are fluidtightly sealed to prevent the flow of fluid into the frame and/or transversely of the frame and into the space which is surrounded by the frame, i.e., into the space between the major central portions of the two light-transmitting plates in an assembled insulating-glass pane or unit.

Alternatively, the plug can be designed in such a way that it is radially expansible and contractible so that, once it is forced into the internal space of the frame by way of the opening in the one wall, it is free to expand in the internal space and to remain in reliable sealing contact with the surrounding mass of sealing compound. The radially expansible plug is preferably formed with an enlarged portion which is inwardly adjacent to the one wall and has a marginal portion surrounding the respective opening. The plug is preferably further formed with a head which is outwardly adjacent to the one wall and whose marginal portion surrounds the opening in the one wall so that the material of the one wall around the respective opening is confined between the enlarged portion and the head of the plug. The plug can be provided with a head irrespective of whether or not its portion in the internal space of the spacer frame is formed with external threads. That end portion of the plug which is remote from the opening in the one wall can extend all the way into or even beyond the (second) opening in the other wall of the spacer frame. Such end portion can have a convex end face which protrudes slightly beyond the outer side of the other wall.

The sealing compound can consist of or it can contain a tough permanently elastic material, such as butyl rubber. This ensures that the compound remains in desirable sealing contact with the inner sides of the two walls (all the way around the respective openings) as well as with the plug in the internal space of the frame for extended periods of time, preferably for the life of the insulating-glass unit.

The threads of the plug and/or the aforementioned enlarged portion of the plug can be arranged to urge the material of the sealing compound against the inner sides of the two walls and into the respective openings so that such compound forms annuli which completely fill the openings all the way around the adjacent parts of the plug. This also contributes to the establishment of a reliable seal between the compound on the one hand and the plug and the wall or walls on the other hand.

The plug is or can be removably received in the opening or openings of the frame. For example, an externally threaded plug can be rotated by a suitable tool whose working end is inserted into a diagonal slot in the head to be withdrawn from the opening or openings in the one wall or both walls of the frame. A plug having an enlarged portion in the internal space can be forcibly extracted by way of the opening in the one wall whereby the enlarged portion undergoes temporary contraction during travel through the opening. Each opening can constitute a hole which is surrounded by an annular surface of the respective wall.

The plug can be formed with a preferably axially extending passage in the form of a blind bore or hole or a channel which is open at both ends. Such passage can be used to admit a gas into the space within the confines of the frame or to permit evacuation of air from the just mentioned space as well as to allow for regulation of pressure in the space within the confines of the frame. If the passage has a closed end in the region of the second opening, such closed end is preferably adjacent to a breakable (e.g., puncturable) membrane or wall portion which can be destroyed if and when the need arises. A pipe can be inserted into that end of the passage which is nearer to the opening in the one wall. The pipe can be surrounded by an annular welded or soldered seam to prevent the flow of air into and from the passage in the region around the inserted part of the pipe. That end of the pipe which is remote from the opening in the one wall can be sealed by soldering, welding or another suitable technique after the pipe has served its purpose, e.g., of admitting a gas into the space within the confines of the frame, or permitting the escape of air or another gas from such space and/or of establishing communication between such space and a plenum chamber or a vacuum chamber in an instrument or another device which is to regulate the pressure in the space within the confines of the frame.

Another feature of the invention resides in the provision of a method of treating a spacer frame which is to be installed in an insulating-glass unit and has a tubular body defining an internal space and includes two walls flanking the internal space. The method comprises the steps of forming at least one of the walls with at least one opening (e.g., a round hole which is preferably formed by removing material from the one wall) for admission of a gaseous fluid into or for evacuation of a fluid from the internal space, introducing into the internal space a sealing compound which is admitted by way of the opening in the one wall and constitutes in the internal space of the frame a block extending between the two walls (at least in immediate proximity of the opening) and sealingly contacting the one wall around the opening so that the internal space of the frame is sealed from the opening and hence from the surrounding atmosphere.

The method preferably further comprises the steps of forming the other wall with a second opening in at least substantial alignment with the opening in the one wall, and the introducing step then comprises establishing and maintaining in the internal space a block of sealing compound (such as butyl rubber) which sealingly contacts the other wall all the way around the second opening and thus prevents the internal space from communicating with the surrounding atmosphere by way of either of the two openings. The introducing step can comprise providing the block in the internal space of the frame with a hole one end of which is immediately adjacent to and is in full register with the opening in the one wall. Such hole can have a second open end which is immediately adjacent to and is in full register with the second opening.

The method preferably further comprises the step of admitting into the internal space of the frame a blowable desiccant prior to the forming step or steps so that the desiccant tends to escape from the internal space by way of the freshly formed opening or openings, and pneumatically removing (e.g., sucking up) the escaping desiccant from the region of the opening or openings at the exterior of the tubular body.

A further feature of the invention resides in the provision of an apparatus which can be used for the practice of the just outlined method, i.e., for treating a spacer frame which is intended for use between two light-transmitting plates and has a tubular body defining an internal space and two walls which are spaced apart from each other and flank the internal space. The apparatus comprises a material removing unit having a tool (such as a rotary drill) for providing the tubular body with an opening (e.g., a round hole) which communicates with the internal space of the tubular body, a source of flowable sealing compound (e.g., butyl rubber or a similar tough elastic sealing substance), and feeding means serving to convey from the source into the tubular body a block of sealing compound by way of the opening which is formed by the material removing unit so that the admitted compound forms in the internal space a block which sealingly contacts the tubular body all around the opening. The admitting means can comprise a nozzle which is receivable in the opening of the tubular body and has at least one orifice for admission of sealing compound into the internal space of the frame in the region immediately adjacent to the opening. The nozzle can constitute or resemble a cylinder having a peripheral surface which is formed with one or more radially or substantially radially extending orifices.

The apparatus preferably further comprises a common support (e.g., an upright housing) for the material removing unit and the feeding means. The nozzle of the feeding means is preferably spaced apart from and in axial alignment with the material removing tool.

If the drill is to form aligned holes in two spaced-apart walls of the tubular body, the frame is placed between the drill and the nozzle so that the drill first makes a hole in one of the walls and thereupon a hole in the other wall, and the frame is thereupon shifted relative to the support and/or vice versa so that the nozzle enters the internal space of the frame by way of the opening in the other wall.

Means can be provided for supplying metered quantities of sealing compound whenever the nozzle penetrates into the internal space of the frame. Such supplying means can meter the sealing compound by feeding the compound at a fixed rate for a selected interval of time, by admitting the compound at a rate which is a function of the resistance encountered by the sealing compound to penetration into the internal space of the frame, or by admitting the compound in quantities which are dependent upon the diameter of the opening through which the nozzle extends.

The novel features which are considered as characteristic of the invention are set forth in particular in the appended claims. The improved apparatus itself, however, both as to its construction and its mode of operation, together with additional features and advantages of the spacer frame, will be best understood upon perusal of the following detailed description of certain specific embodiments with reference to the accompanying drawing.

DESCRIPTION OF THE PREFERRED EMBODIMENTS

Figure 1:
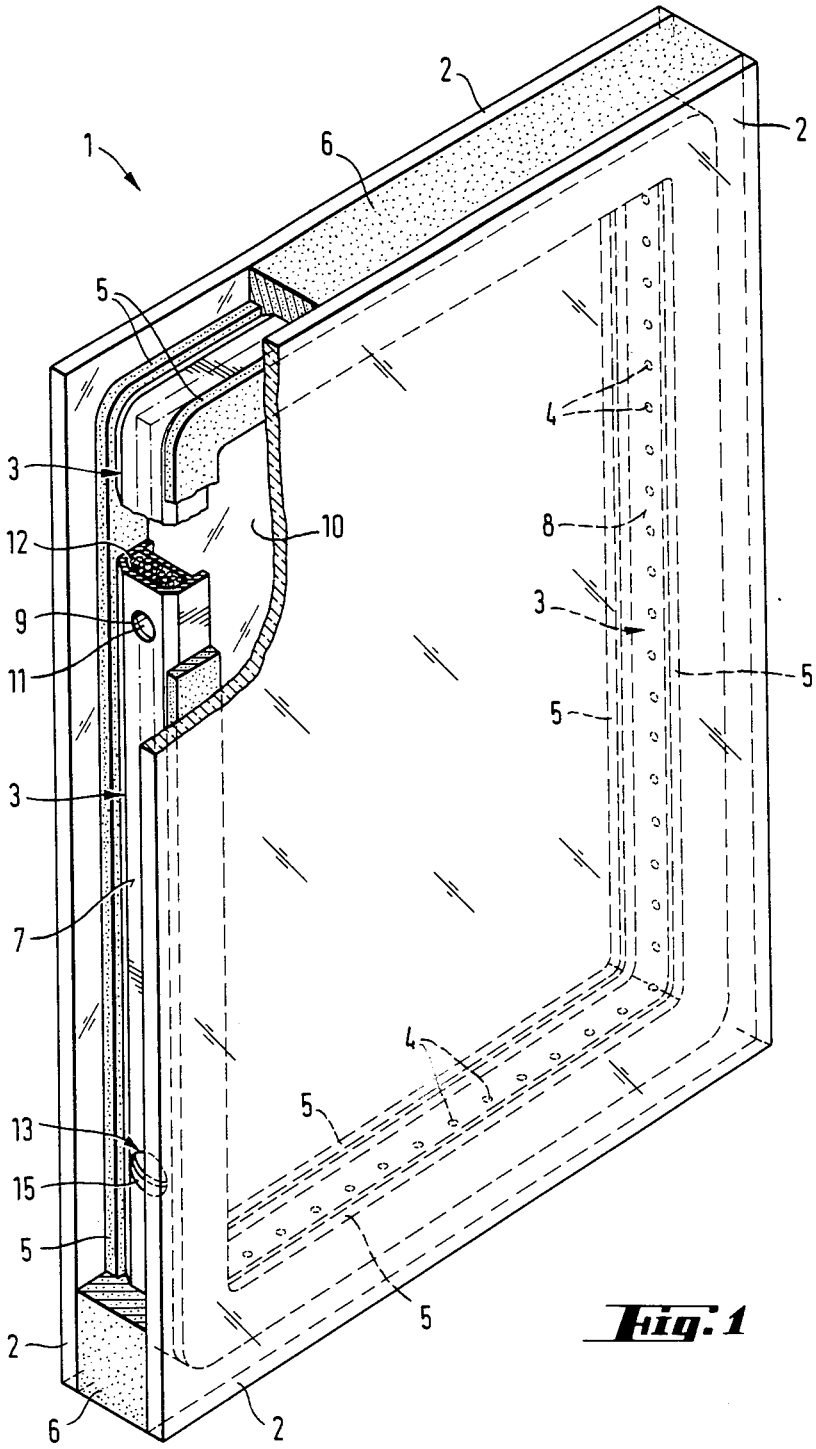
FIG. 1 is a perspective view of an insulating-glass pane or unit having a spacer frame which embodies one form of the invention and is formed with two pairs of aligned openings at different levels, a portion of the layer of sealing compound which surrounds the frame being broken away.
Figure 2:
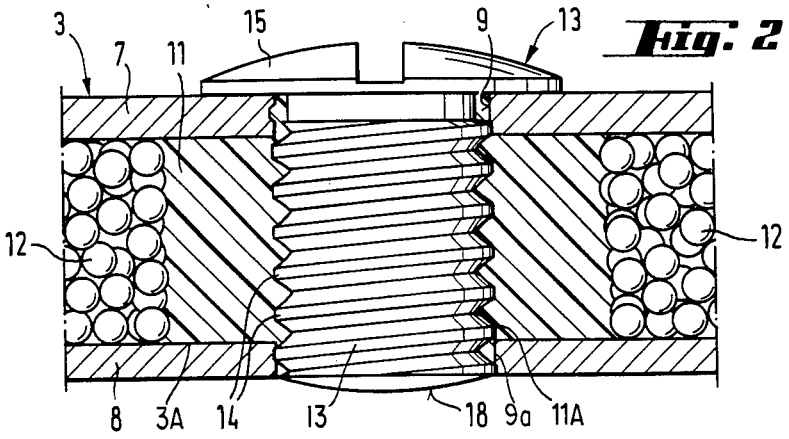
FIG. 2 is an enlarged fragmentary sectional view of the spacer frame, showing a first sealing plug which can be used to assist in reliable sealing of two aligned openings.

FIG. 1 shows an insulating glass pane or unit 1 which is composed of two spaced-apart parallel light-transmitting plates 2 flanking a rectangular spacer frame 3 which is an extruded hollow aluminum profile converted from straight stock into the shape of a rectangle slightly smaller than the outlines of the plates 2. The internal space 3A of the frame 3 is filled with a flowable desiccant 12 (FIG. 2). Minute perforations 4 on the frame 3 denote the presence of desiccant 12 in its internal space 3A. The illustrated frame 3 has been obtained by bending a length of straight hollow profile four times so as to convert the straight profile into a rectangle, preferably in a manner as disclosed in the aforementioned copending patent application Ser. No. 598,444. However, it is also possible to assemble the frame 3 from several straight sections whose ends are mitered so as to be capable of forming joints between pairs of sections that extend at right angles to each other. Strips 5 of sealing compound are inserted between the frame 3 and the respective plates 2. Furthermore, an outer layer 6 of sealing compound is applied around the frame 3 all the way between the inner sides of the plates 2.

The frame 3 is an elongated tubular body having an elongated internal space 3A and including two walls 7, 8 which are spaced apart from and are disposed opposite each other. The walls 7 and 8 extend across the space between the plates 2, i.e., between the two adhesive strips 5. The wall 7 is formed with two spaced-apart openings 9 in the form of circular holes, and each such opening is in register with a similar opening or hole 9*a* in the wall 8. The openings 9 and 9*a* of each pair of such openings communicate with the internal space 3A the major part of which is filled with desiccant 12. The purpose of the holes 9, 9*a* is to permit admission of a gaseous fluid (other than air) into the space 10 which is surrounded by the frame 3 and to permit escape of air from such space. The arrangement is preferably such that the gaseous fluid (other than air) is admitted by way of the lower pair of openings 9, 9*a* (note the location of the head 15 of a plug 13 in the lower part of FIG. 1) and that air is expelled from the space 10 by way of the upper pair of openings 9, 9*a* (only the opening 9 can be seen in FIG. 1). Once the expulsion cf air is completed, i.e., once the space 10 is filled with a fluid other than air, the two pairs of openings 9, 9*a* must be sealed from the space 10, from the internal space 3A of the frame 3 as well as from the surrounding atmosphere. Sealing of the openings 9, 9*a* from the internal space 3A can precede and preferably precedes the sealing of such openings from the space 10 and from the surrounding atmosphere.

As shown in FIG. 1, the opening 9 which is shown therein in the upper portion of the wall 7 of the frame 3 is surrounded by a sealing compound 11 (see particularly FIG. 2) which has a substantially cylindrical hole 11A for the externally threaded shank of the plug 13 (not shown in the upper part of FIG. 1). The sealing compound 11 forms a tubular body or pod which sealingly adheres to the inner side of the wall 7 all the way around the opening 9, which sealingly adheres to the inner side of the wall 8 all the way around the opening 9*a*, and which sealingly adheres to the external threads 14 of the plug 13 so that the compound 11 reliably seals the internal space 3A from the space 10 and from the surrounding atmosphere as well as that such compound prevents the flow of a gaseous fluid from the space 10, through the openings 9, 9*a* and into the surrounding atmosphere or vice versa. The sealing compound 11 serves the additional purpose of preventing particles of desiccant 12 from penetrating into the openings 9 and/or 9*a*, i.e., into the space 10 within the confines of the frame 3 and/or into the surrounding atmosphere. In other words, the frame 3 can be filled or practically filled with a large quantity of desiccant 12 even though it is formed with one or more pairs of aligned openings 9, 9*a*.

The material of the sealing compound 11 is preferably a tough elastic synthetic plastic substance, particularly butyl rubber, which tends to contract around the shank of the plug 13 so as to ensure that the sealing compound is formed with internal threads which are complementary to the external threads 14 of the plug 13. This even further enhances the establishment of a reliable and long-lasting seal between the plug 13 and the compound 11. The external threads 14 of the plug 13 can be said to constitute a means for biasing the material of the sealing compound 11 toward and into the openings 9 and 9*a* so that the compound forms two annuli which completely fill the space between the plug 13 and the surface surrounding the opening 9 of the wall 7 and preferably also the space between the plug 13 and the surface surrounding the opening 9*a* in the wall 8. That end portion of the plug 13 which is remote from the opening 9 is preferably formed with a convex surface 18 which extends beyond the outer side of the wall 8 in the region of the opening 9*a*.

Figure 3:
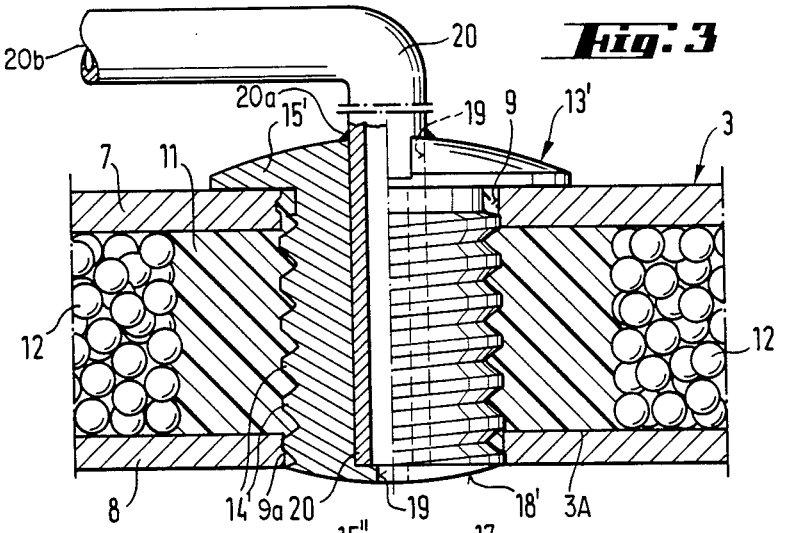
FIG. 3 is a similar fragmentary sectional view but showing a second plug.

The head 15 of the screw-like plug 13 of FIG. 2 has a marginal portion which overlies the outer side of the wall 7 all the way around the opening 9 to further contribute to a desirable sealing action. The plug 13′ which is shown in FIG. 3 is also formed with external threads 14′ which cut a thread into the mass of sealing compound 11 in the internal space 3A of the frame 3. The difference between the plugs 13, 13′ of FIGS. 2 and 3 is that the plug 13′ of FIG. 3 has an axial passage with two open ends, one in the convex surface 18′ and the other in the head 15′.

Figure 4:
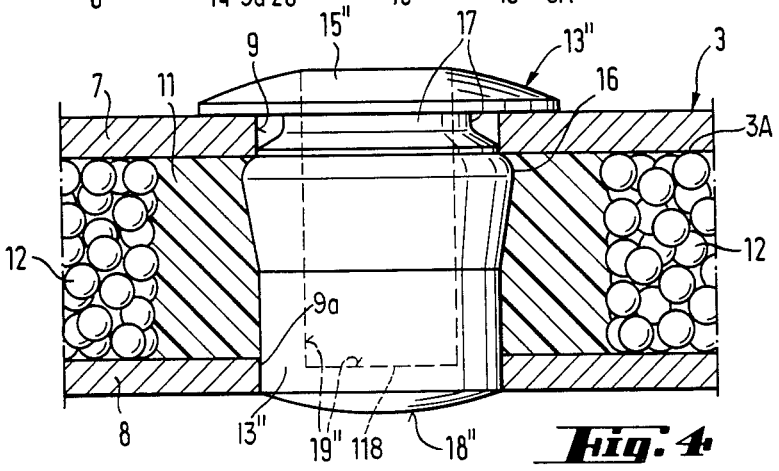
FIG. 4 is a similar fragmentary sectional view but showing a third plug.

FIG. 4 shows a modified plug 13″ which consists of a material permitting of radial expansion and contraction of the plug. Such deformability of the plug 13″ can be caused and/or enhanced by the provision of a large-diameter axial passage 19″ one end of which is sealed by a puncturable or otherwise breakable membrane 118 so as to allow for communication between the passage 19″ and the space 10 within the confines the frame 3. The plug 13″ has an enlarged portion 16 which is adjacent to the inner side of the wall 7 and surrounds the opening 9. The head 15″ of the plug 13″ has a marginal portion which overlies the outer side of the wall 7 all around the opening 9, i.e., the wall portion immediately surrounding the opening 9 is sealingly pinched or clamped between the head 15" and the enlarged portion 16 to enhance the sealing action in the region of the opening 9. The cylindrical portion of the peripheral surface of the plug 13" in the region of its end face 18" is snugly received in the opening 9*a* of the wall 8.

The enlarged portion 16 of the plug 13" is caused to contract radially during forcible insertion into the space 3A by way of the opening 9, and the portion 16 thereupon expands radially to stress the adjacent portion of the mass of sealing compound 11 in the space 3A and to thus establish a reliable seal with the compound. The enlarged portion 16 also serves as a means for urging the material of the compound 11 toward and into sealing contact with the inner side of the wall 7 all the way around the opening 9. The distance between the head 15" and the enlarged portion 16 (as considered in the axial direction of the plug 13") need not appreciably exceed the thickness of the wall 7 and can be even less so that the enlarged portion 16 of the elastically deformable plug 13" bears against the inner side of the wall 7 as soon as it has been caused to penetrate into the internal space 3A of the frame 3. The enlarged portion 16 and the head 15" then define an annular groove 17 which is surrounded by the surface bounding the opening 9 in the wall 7.

The utilization of a tough elastic sealing compound, such as butyl rubber, is desirable and advantageous because such compound ensures the establishment of a seal which lasts for the life of the pane 1 and is effective not only along the external surface of the plug 13, 13' or 13" in the respective internal space 3A but also along the inner sides of the walls 7 and 8 all the way around the respective openings 9 and 9*a*. Nevertheless, the plug 13, 13' or 13" can be removed from the respective pair of openings, particularly the externally threaded plug 13 or 13' which must merely receive torque in a direction to expel its shank from the internal thread which is formed by the respective mass of sealing compound 11. Removal of the plug is desirable or necessary when the pressure in the space 10 within the confines of the frame 3 is to be altered upon completed assembly of the pane 1. The plug 13" of FIG. 4 can be forcibly extracted from the respective openings 9, 9*a* by the working end of a screwdriver which is introduced between the head 15" and the outer side of the wall 7 to force the enlarged portion 16 outwardly and through the opening 9. The plug 13, 13' or 13" can be reinserted without sacrificing the sealing action because the sealing compound 11 is preferably a substance whose elasticity remains intact or acceptable for long periods of time, preferably at least for the life of pane 1. Thus, the material of the compound 1 tends to penetrate into the space which is formed in response to removal of the plug 13, 13' or 13" so that the reinserted plug must displace such material and is caused to again establish a highly reliable seal therewith.

The membrane 118 at the inner end of the passage 19" in the plug 13" of FIG. 4 can be punctured, when necessary, so as to allow for admission of a gas into or for evacuation of a gas from the space 10.

FIG. 3 shows that the larger-diameter portion of the passage 19 in the plug 13' receives one end portion of a pipe 20 or a similar conduit which can be used for admission of a gas into or for evacuation of a gas from the space 10 within the confines of the frame 1. The pipe 20 can be permanently and sealingly installed in the plug 13' by soldering (at 20*a*) its external surface to the exposed side of the head 15' all the way around the respective end of the passage 19. The exposed end of the pipe 20 can also be sealed (e.g., at or in the region of 20*b*) so as to positively prevent the flow of any fluids via conduit 20 and into or from the passage 19 (once the space 10 is filled with a selected fluid medium).

The conduit 20 can be used for admission of a fluid into or for evacuation of a fluid from the space 10 subsequent to installation of the frame 3 between the plates 2. Furthermore, such conduit can be used for attachment of the pane 1 to a regulating device which maintains the pressure in the space 10 at a selected value or which changes the pressure in the space 10 if the pane 1 is to be used in regions where the pressure around the pane is different from region to region.

The sealing compound in the internal space 3A of the tubular body of the frame 3 performs several functions. Thus, such compound seals the desiccant 12 in the internal space 3A so that the desiccant cannot escape by way of the opening 9 and/or 9*a*, either into the space 10 or into the surrounding atmosphere. In addition, the compound 11 cooperates with the plug 13, 13' or 13" to ensure that moisture cannot penetrate into the space 10 so that the light transmissivity of the plates 2 cannot be affected by condensate. Still further, the compound 11 in the space 3A obviates the need for the external layer 6 of sealing compound or renders it possible to reduce the thickness of the layer 6 so that the latter merely conceals the wall 7 but need not perform any, or any pronounced, sealing action. The feature that the plug 13, 13' or 13" actually shifts the sealing compound 11 (i.e., that it expands the hole 11A in the compound 11) also contributes to a superior and longer-lasting sealing effect.

A plug (13 or 13') which is formed with an external thread (14 or 14') exhibits the advantage that the area of contact between the compound 11 and the shank of the plug is greatly increased to thus enhance the quality of the seal between 11 and 13 or 13'. Moreover, and since the thread 14 or 14' cuts a thread into the body of sealing compound 11 in the internal space 3A of the frame 3 which is shown in FIG. 2 or 3, each and every portion of the thread 14 or 14' is compelled to come into intimate sealing contact with the adjacent portion of the block of sealing compound 11. The utilization of an externally threaded plug also simplifies the insertion or extraction of such plug. In fact, it is also possible to insert the plug 13 or 3' only in part so that its shank extends through the opening 9 but need not reach the opening 9*a*. Partial insertion of the plug 13 or 13' may be desirable and advantageous if the holes 9 and 9*a* are to be used for admission of a gas into, or for evacuation of a gas from, the space 10 subsequent to application of the layer 6. Thus, the extraction of a plug 13 or 13' subsequent to application of the layer 6 entails only minor damage to the layer 6 so that the latter can be repaired with a minimum of effort and at a negligible cost.

The provision of a head 15, 15' or 15" is desirable and advantageous because the head also contributes to the sealing action and because the head enables the operator to readily ascertain whether or not the plug 13, 13' or 13" has been fully inserted into the respective mass of sealing compound 11.

An advantage of using butyl rubber or a similar sealing compound is that the latter exhibits sufficient stability so that it does not flow uncontrollably within and/or from the internal space 3A. Thus, once the hole 11A in the compound 11 is established (e.g., by the nozzle 25 of FIG. 5), the dimensions of the hole 11A remain at least substantially unchanged until the shank of the plug 13, 13' or 13'' is introduced to form a reliable seal between the plug and the surrounding body of sealing compound. The ability of the sealing compound to be displaced by the external threads 14 or 14' or by the enlarged portion 16 renders it possible to ensure fluidtight sealing of the opening 9 and/or 9*a* all the way around the adjacent portion of the plug, even if the diameter of the plug deviates from a standard value so that the width of the annular clearance between the plug and the wall 8 and/or 7 within the respective opening 9*a* or 9 varies from frame to frame.

While it is possible to employ a relatively short plug which extends only into the opening 9 or 9*a* and terminates short of the other (registering) opening, the utilization of a relatively long plug which extends from the outer side of the wall 7 to the outer side of the wall 8 is preferred at this time because such plug can be more accurately located with reference to the frame and contributes to more reliable sealing of both openings. The plug can also contribute to the eye-pleasing appearance of the pane 1, especially if the material of the plug is the same as that of the frame 3. Thus, the convex surface 18, 18' or 18'' is hardly noticeable if such surface is substantially flush with the outer side of the wall 8.

The plug will be removed primarily in order to change the pressure in the space 10, i.e., if the operator decides that the pressure in the space 10 should be altered subsequent to assembling of the frame 3 with the strips 5 and plates 2.

If the plug is provided with a conduit (such as the pipe 20 of FIG. 3), the latter can extend outwardly from the pane 1 so that its outer end is accessible at the exterior of the window frame or door frame into which the pane 1 is inserted. In other words, the operator is in a position to regulate the pressure in the space 10 subsequent to installation of the pane 1 in a structure (door or window) in which the pane is to be put to use. The pipe 20 is, or can be, made of a metallic material so that it can be readily soldered or similarly bonded to the head 15' of the plug 13'. The provision of a seal at 20*a* and/or 20*b* renders it possible to prevent undesirable and uncontrollable communication between the space 10 and the surrounding atmosphere. The aforementioned pressure regulating device which is connectable to the outer end of the pipe 20 can be used to regulate the pressure in two or more discrete panes 1. By way of example, if the pane 1 is installed in the window or in the door of a mountain railroad, it might be desirable or necessary to change the pressure in the space 10 at different elevations above the sea level. The pipe 20 renders such pressure changes possible without affecting the integrity of the seal between the pipe and the plug 13', between the plug 13' and the compound 11 in the space 3A and/or between the compound 11 and the walls 7, 8 of the frame 3.

Figure 5:
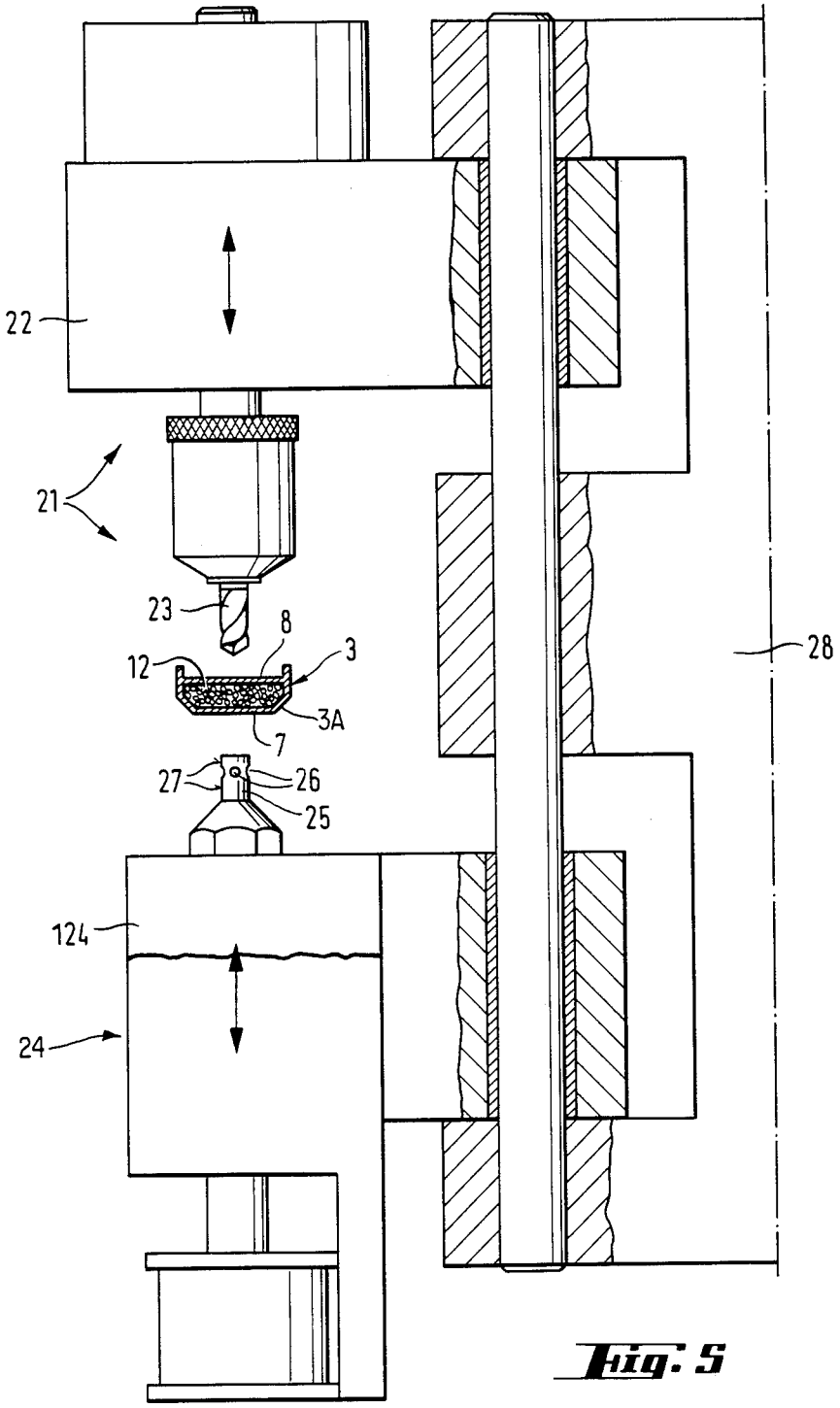
FIG. 5 is a fragmentary schematic partly elevational and partly sectional view of an apparatus which can be utilized for the practice of the method of making and sealing holes in spacer frames of the type shown in FIGS. 1 to 4.

FIG. 5 shows an apparatus 21 which can be used for the making of openings 9, 9*a* and for admission of a sealing compound into the internal spaces 3A of frames 3. The apparatus comprises a stationary or mobile support 28 for a material removing unit 22 having a rotary drill 23 or an analogous tool serving to remove material first from the wall 7 and thereupon from the wall 8 (or vice versa) of a frame 3 which is placed into the space between the tool 23 and a nozzle 25 forming part of the means for feeding sealing compound from a source 24 into the internal space 3A by way of the opening 9*a* in the wall 8 or by way of the opening 9 in the wall 7 (depending on the orientation of the frame 3 between the tool and the nozzle). The unit 22 can constitute a conventional power-operated drilling machine with a suitable chuck which removably holds the tool 23 in alignment with the nozzle 25. The nozzle 25 has a cylindrical peripheral surface 27 which is formed with an annulus of, for example, four equidistant radially extending orifices 26 for admission of sealing compound into the space 3A subsequent to penetration of the upper portion of the nozzle 25 into the frame 3 by way of the opening 9 in the lower wall 7, as viewed in FIG. 5. The cylindrical peripheral surface 27 of the nozzle 25 can enter the openings 9, 9*a* of the walls 7, 8 after the tool 23 has been lifted or after the frame 3 has been lowered below the tip of the tool.

The apparatus 21 of FIG. 5 further comprises a suitable metering device 124 which is installed in its lower part and serves to determine the quantities of sealing compound which are admitted into the frame 3 to form a mass or pod which sealingly surrounds the inner sides of the walls 7, 8 around the respective openings 9 and 9*a*. The cylindrical peripheral surface 27 of the nozzle 25 provides the freshly formed mass of sealing compound 11 in the internal space 3A of the frame with an axial hole 11A (FIG. 2) which extends between the openings 9, 9*a* and facilitates predictable introduction of a plug 13, 13' or 13''. At such time, the peripheral surface 27 of the nozzle 25 seals the openings 9 and 9*a*, and the material which issues from the orifices 26 displaces the adjacent particles of desiccant 12 so that the sealing compound 11 forms a substantially tubular socket whose ends are in sealing engagement with the inner sides of the walls 7, 8 and whose centrally located hole 11A is ready to receive the shank of the plug 13, 13' or 13''. Means (not specifically shown) can be provided to gather the desiccant 12 which escapes from the opening 9 and/or 9*a* upon extraction of the tool 23 and prior to full introduction of the nozzle 25. Such gathering means can include a pneumatic device acting not unlike a vacuum cleaner.

The metering device 124 can be equipped with a timer which ensures that the sealing compound is admitted into the nozzle 25 at a fixed rate for a selected interval of time. Alternatively, the metering device 124 can be equipped with a gauge serving to monitor the resistance which is encountered by the compound in the nozzle 25 to penetration into the internal space 3A of the frame 3 whose openings 9, 9*a* receive the nozzle 25. The gauge terminates the admission of sealing compound when the resistance reaches a given value indicating that the sealing compound forms an acceptable pod or mass which is in adequate sealing engagement with the inner sides of the walls 7, 8 around the respective openings 9 and 9*a*. Still further, the metering device 124 can be designed to admit sealing compound in quantities which are dependent on the diameters of the openings 9 and 9*a*.

The escape of some desiccant 12 from the internal space 3A of the frame 3 upon extraction of the drill 23 from the freshly formed openings 9 and 9*a* is actually desirable because this provides room for admission of requisite quantities of sealing compound 11 which forms the block extending from the inner side of the wall 7 to the inner side of the wall 8 and having a hole 11A for the plug 13, 13' or 13''. As mentioned above, the hole 11A is formed by the cylindrical peripheral surface 27 of the nozzle 25.

It is clear that the apparatus 21 is provided with means for maintaining the sealing compound in the source 24 at a reasonable pressure or for subjecting the compound to a pressure which suffices to ensure that the compound will flow into the nozzle 25 to issue from the orifices 26 in order to form the body of sealing compound which extends between the inner sides of the walls 7, 8 and has a hole for the plug.

The construction and mode of operation of the metering device 124 will further depend on the dimensions of the frame 3 and on the nature (viscosity) of the sealing compound. Care is to be exercised to avoid the admission of excessive quantities of sealing compound and/or the admission of such compound at an excessive pressure so that the compound would tend to escape from the internal space 3A of the frame and would detract from the appearance of the finished pane.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A spacer frame for insulating-glass panes, comprising a tubular body defining an internal space and having at least one opening which establishes communication between said space and the exterior of said body; a mass of tough elastic sealing compound confined in a portion of said space in the region of and sealingly surrounding said opening so that the opening is sealed from the reminder of said internal space, said compound having a prefabricated hole in register with said opening; and a plug removably extending into said hole by way of said opening and establishing a seal with said compound, said compound exhibiting a tendency to contract against the plug in said space.

2. The frame of claim 1, wherein said body includes two spaced-apart walls and said opening is provided in one of said walls, the other of said walls having a second opening in at least substantial alignment with the opening of said one wall, said compound sealingly surrounding said second opening and said plug extending from the opening of said one wall toward said second opening.

3. The frame of claim 1, wherein said plug has an external thread and is driven into the sealing compound in said space so that the compound exhibits an internal thread mating with said external thread.

4. The frame of claim 1, wherein said tubular body has a wall which is provided with said opening and has an inner side and an outer side, said plug being radially expansible and contractible and having an enlarged portion overlying the inner side of said wall around said opening.

5. The frame of claim 4, wherein said plug has a head which is adjacent to the outer side of said wall and has a portion surrounding said opening.

6. The frame of claim 5, wherein said enlarge and said head define an annular groove for a portion of said wall.

7. The frame of claim 1, wherein said tubular body h an outer side and said plug has a head which is adjacent to the outer side of said body and includes a portion surrounding said opening.

8. The frame of claim 1, wherein said sealing compound contains butyl rubber.

9. The frame of claim 1, wherein said compound consists of a permanently elastomeric material.

10. The frame of claim 1, wherein said tubular body has a wall which is provided with said opening and has an inner side, said plug having means for urging the material of said compound into said opening so that the thus displaced material seals the opening around said plug.

11. The frame of claim 1, wherein said tubular body has a first wall which is provided with said opening and a second wall disposed opposite said first wall, said compound being disposed between said walls and said plug extending from the exterior of said tubular body, through said opening and toward and at least close to said second wall.

12. The frame of claim 11, wherein said second wall has a second opening in at least substantial register with the opening of said first wall; said plug having an end portion extending into and at least substantially filling said second opening.

13. The frame of claim 1, further comprising a desiccant in said space.

14. A spacer frame for insulating-glass panes, comprising a tubular body defining an internal space and having at least one opening which establishes communication between said space and the exterior of said body; a mass of tough elastic sealing compound confined in a portion of said space in the region of and sealingly surrounding said opening so that the opening is sealed from the remainder of said internal space, said compound having a prefabricated hole in register with said opening; and a plug having a substantially axially extending passage and removably extending into said hole by way of said opening and establishing a seal with said compound.

15. The frame of claim 14, wherein said passage has an open end in the region of said opening and a closed second end remote from said opening, said plug comprising a breakable membrane adjacent to said closed second end.

16. The frame of claim 14, wherein said passage has an open first end remote from said opening and a second end in the region of said opening; and further comprising a pipe having an open end communicating with or arranged to communicate with the second end of said passage.

17. The frame of claim 14, wherein said passage is open in the region of said opening; and further comprising a pipe extending into said passage, and means for sealingly securing said pipe to said plug so that the portion of the pipe which extends into said passage is sealed from the surrounding atmosphere.

18. The frame of claim 17, wherein said pipe has an open end in said plug and a closed end outside of said plug.

19. The frame of claim 17, wherein said pipe has an open first end in said plug and a second end; and further comprising a pressure regulating device connected with the second end of said pipe and arranged to maintain the pressure in said pipe within a predetermined range.

* * * * *